United States Patent [19]

Brieger

[11] 4,436,155

[45] Mar. 13, 1984

[54] WELL CLEANUP AND COMPLETION APPARATUS

[75] Inventor: Emmet F. Brieger, Alburquerque, N. Mex.

[73] Assignee: GEO Vann, Inc., Houston, Tex.

[21] Appl. No.: 383,746

[22] Filed: Jun. 1, 1982

[51] Int. Cl.[3] ..... E21B 43/11

[52] U.S. Cl. ..... 166/297; 175/4.52; 166/55.1

[58] Field of Search ..... 166/297, 369, 312, 55, 166/55.1, 63, 299, 325; 175/4.52, 2

[56] References Cited

U.S. PATENT DOCUMENTS

| | | | |
|---|---|---|---|
| 2,745,495 | 5/1956 | Taylor | 166/297 |
| 2,866,508 | 12/1958 | Church | 175/4.52 |
| 3,118,501 | 1/1964 | Kenley | 166/55.1 X |
| 4,372,384 | 2/1983 | Kinney | 166/319 X |

*Primary Examiner*—Stephen J. Novosad
*Assistant Examiner*—Michael Starinsky

[57] ABSTRACT

A well cleanup and completion apparatus and technique. A packer is located downhole in a borehole, and a tool string comprising a one-way vent assembly and a one-way circulating valve assembly is connected above a perforating gun. The tool string is used to run the gun downhole through the packer until the gun arrives at a location adjacent to the formation to be perforated. During this time, the packer assembly must be in a configuration which admits flow from the lower to the upper annulus. Cleaning fluid is circulated down the entire tool string to the one-way circulating valve assembly located immediately above the firing head of the gun, thereby displacing fluid from the lower annulus, and cleaning any debris from the gun firing head. The packer is next closed, the gun detonated, whereupon the formation is perforated and production fluid flows through the perforations, up the lower annulus, into the one-way vent assembly located below the packer, into the tubing, and to the surface of the ground. Accordingly, the apparatus enables the gun and the borehole annulus adjacent the gun to be cleaned, thereby assuring that the well is properly completed in a single trip into the wellbore.

19 Claims, 7 Drawing Figures

WELL CLEANUP AND COMPLETION APPARATUS

REFERENCE TO RELATED APPLICATIONS

This application is one of a group of patent applications assigned to a common assignee all contemporaneously filed and relating to bottom hole completions, including U.S. patent application Ser. No. 384,508 filed June 3, 1982, entitled "Gun Below Packer Completion Tool String;" U.S. patent application Ser. No. 385,708 filed June 7, 1982, entitled "Well Cleanup and Completion Method and Apparatus;" and U.S. patent application Ser. No. 385,707 filed June 7, 1982, entitled "Gun Firing System Using Fluid Filled Pressure Balance Tubing." Other related patents and applications of assignee include U.S. Pat. No. 4,040,482, entitled "Optional Fire and Release Tool and Method" and U.S. patent application Ser. No. 175,515, filed Aug. 5, 1980, entitled "Ball Switch Revise and Method." These cited patents and applications and the art cited with request thereto are presented to the U.S. Patent and Trademark Office in order to make disclosure of Applicant's prior art knowledge.

BACKGROUND OF THE INVENTION

This invention relates to the completion of wells by lowering a perforating gun on tubing through a packer previously set in the casing, the packer typically being a permanent or other heavy duty packer suitable for a high pressure, high temperature environment, the packers being run in on a wire line or tubing.

The completion of wells is known to those skilled in the art as evidenced by the following patents: Vann U.S. Pat. No. 3,706,344; Vann, et al. U.S. Pat. No. 3,871,448; Vann U.S. Pat. No. 3,966,236; and Vann U.S. Pat. No. 4,066,282.

In carrying out the above completion techniques, it is advantageous to employ a packer actuated vent assembly, such as disclosed in some of the above patents; and perforating guns, such as disclosed in the above mentioned U.S. Pat. No. 3,706,344 as well as U.S. Pat. No. 4,140,188. Various different packers, including permanent packers, are known such as described in the 1974–75 Baker Catalog, Sections III, IV and V; Baker Oil Tools, Inc., Edition of the Composite Catalog of Oil Field Equipment and Service, published by The Gulf Publishing Co., Houston, Texas, See also Volume 1, of the 1980–81 Edition of the Composite Catalog of Oil Field Equipment and Services, pages 640–772, referring to Baker Packer Completions Services' Packer Systems.

It is essential for safety reasons that control be maintained over deep, high temperature, high pressure wells. Such a well might be over 10,000 feet deep, have a bottomhole temperature of about 300° F., and a bottomhole pressure of over 5,000 psi. Such control is initially maintained by a hydrostatic head and then later maintained by setting a permanent packer in the cased borehole. One object is to prevent any blowout of the well. A replacement of the mud with a lighter clean fluid prior to the setting of a permanent packer may remove the margin of safety. Thus, it is desirable to keep heavy mud in such a well for as long as possible to insure that the production zone is killed. Once the packer has been set and the cased borehole can be sealed off, the margin of safety is insured. A hydrostatic head is still maintained in the annulus above the packer. A permanent packer is almost always used in a deep, hot, high pressure well. A permanent packer will contain and withstand the temperatures and pressures of such a well since a permanent packer is a more heavy duty packer. Thus, very few customers will permit a retrievable packer in such a well where a retrievable packer is mounted on a tubing string with a perforating gun. For example, a retrievable packer might fail after the mud was removed with a lighter fluid in the tubing string or where the tubing string was swabbed dry in preparation for perforation. A retrievable packer, mounted on a tubing string with a perforating gun, is generally considered inadequate to control a well of this environment.

The permanent packer may be run into the well alone or suspending a perforating gun. Casing size is one of the principal factors determining whether a permanent packer suspending the perforating gun or a permanent packer alone is run and set in the well. Where the cased borehole has at least a 7 inch casing, the permanent packer can have an internal bore with an internal diameter of 4 inches. A 4-inch packer bore will permit the lowering of a sufficiently large sized perforating gun to provide adequate perforations. Thus, the packer bore size dictates the maximum sized perforating gun which can be used in the well when the gun is lowered into the well after the packer is set. If the casing has an interior diameter of less than 7 inches or even if the casing is a 7-inch casing but a big perforating gun is required, it would be necessary that the perforating gun be suspended below the packer. Such a system is described in patent application Ser. No. 384,508 filed June 3, 1982, entitled "Gun Below Completion Tool String" invented by Brieger, George and Colle.

Although an apparatus such as disclosed in the Brieger, George, and Colle application may be used to suspend the gun from the permanent packer, it is more desirable to lower and set the permanent packer within the well where the packer does not support the perforating gun. Running the permanent packer alone into the well on a wireline is a more reliable and simpler method. Running the permanent packer alone is less complicated and a more desirable system than a permanent packer suspending the perforating gun. Further, if anything goes wrong after the packer and gun have been run, there is an opportunity to not run the gun or remove the gun from the hole. If a permanent packer suspending the gun had been run, then it would be necessary to unset the packer which may require either drilling or milling to remove the packer or an attempt to fish the packer for retrieval. Further, where the gun is suspended below the packer, the packer is set and a separate tubing string must be run into the well for circulation and detonation of the gun. Although running the permanent packer into the well with a wireline is preferred, a tubing string could be used. However, the use of a tubing string would require an extra trip into the well.

Generally, there is little problem lowering the permanent packer on a wireline even though the well is full of drilling mud. The permanent packer is permitted to more or less fall-feed itself and settle into the well on the wireline. Where lowering the permanent packer on a wireline becomes a problem, generally the permanent packer is pulled out of the hole and the mud is reconditioned to the point where the permanent packer will lower itself on a wireline into the well. However, the reconditioning of mud lasts only a short period of time and it is necessary to pull the permanent packer, recondition the mud, and lower the permanent packer to the desired position quickly.

Although the environment just described for the present invention has been in relation to the use of a permanent packer, there are applications where the present invention could be used with a retrievable packer, such as in the case of a recompletion. For example, where squeeze perforations have been performed, the old perforations are plugged by setting a packer and pumping cement down into the well and into any open performations. The cement is squeezed back into the formation to plug all the holes. Where the old well still has a fairly high pressure and a water column is not sufficient to keep it killed, it is often desired to have a hydrostatic head of drilling mud in the tubing string suspending the perforating gun to be sure that there is no release of any of the hydrostatic head off of the squeezed perforations until a packer is set for making new perforations. Thus, the well includes drilling mud from the production zone to the surface to insure protection against a blowout or to insure there is no breakdown of the squeeze perforations until everything is prepared to create new perforations. The above is one example of why mud might be permitted in the tubing string while running a retrievable packer and perforating gun into the well.

Where the tubing string may be left in the hole for a long period of time prior to completing the well in the above-described applications, the surrounding mud often contaminates the interior of the tool. The heavy particles of mud and other suspended matter gravitate toward the bottom of the tool string where the contaminant densifies into a heavy layer of material. The longer the tool string is left downhole, the more the drilling mud is permitted to settle and congeal. In a perforating gun having a bar actuated gun firing head, for example, it is possible for the mud to densify about the gun firing head mechanism and become compacted and viscous to such an extent that the gun firing head cannot be impacted and detonated. The firing mechanism requires 20 ft-lbs of impact for detonation. Where the mud is permitted to settle and congeal, it may well be impossible to attain 20 ft-lbs of impact from the bar.

It is often desirable to complete the well at some subsequent time and the downhole may be left dormant. For example, one may wish to leave the downhole dormant until one is prepared to complete several wells and tie them all in at one time. However, during such an interval, the heavy particles of the mud and other suspended matter gravitate toward the bottom where the contaminants density into a heavy layer of material. The longer the time period, the more the drilling mud is permitted to settle and congeal. Thus, it is possible for the mud to densify in the lower portion of the hole and become compacted. Thus, it is desirable to circulate into a well to remove compacted and congealed material therein.

The well fluid often includes extremely heavy mud, much like clay, which fills the lower end of the cased wellbore. When the tool string is run into the hole, mud enters the vent port and is displaced back up the tubing string. When a firing mechanism, such as a bar, is subsequently dropped downhole in order to complete the well, the downwardly traveling bar encounters the heavy mud and is decelerated. Sometimes the mud and other debris is so dense the bar cannot penetrate the stratified material.

The problem of contamination is compounded when the perforating tool string is left downhole for any substantial length of time. Accordingly, it would be desirable to have made available a perforating tool string which can be manipulated in a manner whereby the lower borehole annulus is cleaned by displacement of the heavy debris-laden well fluid with cleaning fluid, as for example fresh clean oil, fresh water, or salt water. The elimination of the contaminants from the lower borehole greatly enhances the operation of the perforating gun device.

The well completion method and apparatus of the present invention overcomes the problems of the above applications by preventing mud and debris from collecting around the firing mechanism and permitting circulation for the removal of any mud and debris. Because circulation is desired in the case of a permanent packer and because a hydrostatic head may be desired in the tubing string in the case of a retrievable packer, the tubing string of the present invention is run into the well open permitting the string to completely fill up with drilling mud as it is run into the well.

During completion of a well, where a permanent packer is installed downhole in the borehole and a packing mandrel is seated within the packer, it is necessary for provision to be made for flow to occur from the lower to the upper annulus during the seating of the packer mandrel because of the incompressibility characteristics of the well fluids. It is undesirable for the lower annulus to be vented directly into the tubing string, because the contaminated well fluid is translocated from the lower annulus directly into the tubing string where the contaminates gravitate in a downward direction and obscure the gun firing head mechanism.

In some permanent completion apparatus, it is sometimes desirable to run a dry, clean tubing into the borehole. However, when a dry tubing is run into the borehole, the packer set, and a vent assembly subsequently opened, the annulus fluid is no longer fully closed off so that the flow of additional fluid from the formation into the annulus is resisted only by the hydrostatic head in the tubing. Consequently, if the formation pressure exceeds the hydrostatic head an appreciable amount, it is possible to lose control of the well when the shaped charges of the gun are exploded, releasing formation pressure to the annulus.

In the case of a permanent packer, the present invention has the advantage that the simpler and less complicated method of running the permanent packer into the well alone on a wireline can be used, the permanent packer can be set without making an additional tubing run, the perforating gun assembly is not permanently attached below the permanent packer so that it can be removed easily from the well if problems arise, and the tool string with perforating gun and circulation apparatus can all be lowered into the well at one time. Once on location for perforation, after the well has been cleaned and the well is ready to be flanged up and the gun detonated, circulation is permitted down to the firing mechanism of the perforating gun so that there is no level of mud extending in the casing above the perforating gun. However, the present invention permits any desired amount of the mud or any other fluid to remain in the well for safety, the permanent packer can be run in and set independent from the rest of the tools, circulation can occur as the perforating gun is being lowered into the well, and then the tubing string can sting through the packer in preparation for detonation.

The present invention may also be used with a retrievable packer to circulate and displace the mud with a lighter fluid as the tubing-conveyed perforating gun is lowered into the well. The lighter fluid in the tubing string can be partially displaced by nitrogen to maintain an underbalance or pressure differential. The retrievable packer is then set to isolate the lower part of the well. There is now a light clean fluid extending from the firing head of the perforating gun throughout the tubing string to insure a sufficient impact of the detonator bar on the firing mechanism. The method and apparatus of the present invention accomplishes these objectives.

Method and apparatus which overcome the above drawbacks and provide the above desirable technique are the subject of the present invention.

SUMMARY OF THE INVENTION

According to the invention, there is provided method and apparatus for cleaning and completing a wellbore, and for preventing malfunction of a perforating gun device. The method is carried out by the provision of a tool string having a perforating gun supported at the lower end thereof, a packer device for dividing the borehole annulus into an upper and lower annulus, a one-way vent assembly positioned in the string and below the packer, and a one-way circulation port located above the gun firing mechanism. The gun is run dowhole on the end of the tool string, and cleaning fluid is pumped down through the tool string to the one-way circulating valve, whereupon the valve immediately above the firing head is forced open by cleaning fluid which displaces the well fluid from the lower annulus. The displaced fluid flows up the lower annulus, up through an opening in the packer device, and towards the surface of the earth. The packer is set, and the gun detonated, whereupon produced fluid can then flow from the payzone, through the perforations, and up the lower annulus where the pressure differential forces the valve element of the one-way vent assembly to move into the open position. The produced fluid flows into the tubing string and up to the surface of the earth where the production is gathered.

Accordingly, a primary object of the present invention is the provision of apparatus which enables the method of the present invention to be carried out in conjunction with completion of a formation located downhole in a borehole.

A further object of the present invention is the provision of a method for cleaning a lower annulus of a borehole and subsequently perforating the casing thereof, and thereafter producing the well; all in a single trip into the borehole.

Still another object of the present invention is the provision of both method and apparatus by which a cased borehole is divided into a lower and an upper annulus, and fluid can be flowed axially downhole to clean the lower borehole by displacement of well fluids with cleaning fluid, and thereafter a downhole formation can be completed and the production therefrom flowed up the lower annulus, into the axial flow path, and to the surface of the ground.

A still further object of the invention is the provision of a well completion system which enables a tool string to be run through a packer device without hydraulic blocking, and which cleans debris from selected parts of the borehole.

These and various other objects and advantages of the invention will become readily apparent to those skilled in the art upon reading the following detailed description and claims and by referring to the accompanying drawings.

The above objects are attained in accordance with the present invention by the provision of a method for use with apparatus fabricated in a manner substantially as described in the above abstract and summary.

DETAILED DESCRIPTION OF THE PREFERRED EMBODIMENTS

Figure 1:
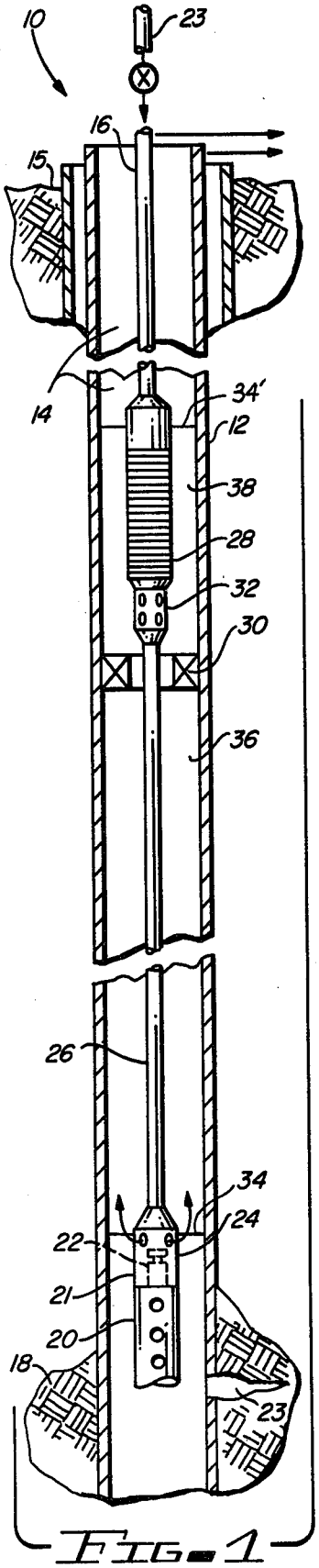
FIG. 1 is a diagrammatic representation of a cross-sectional view showing a borehole having apparatus made in accordance with the present invention included therewithin.
Figure 2:
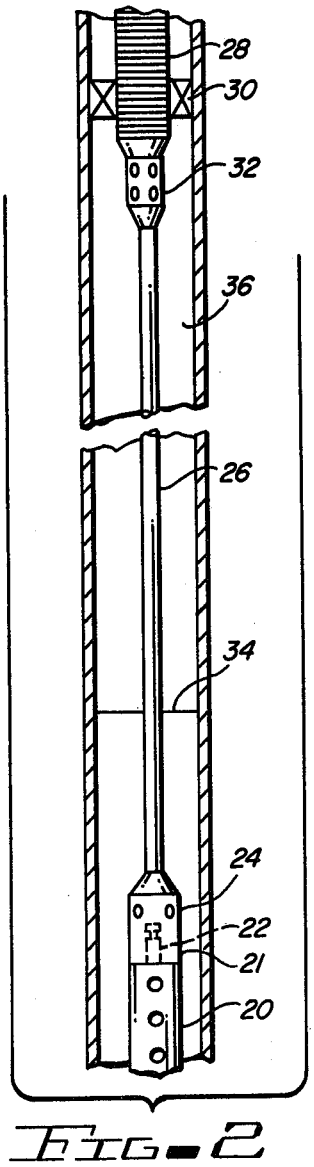
FIG. 2 is a diagrammatic representation of part of the disclosure seen in FIG. 1, with the apparatus thereof being shown in a different configuration.

In the figures of the drawings, and in particular, FIGS. 1 and 2, there is broadly disclosed apparatus by which the present invention can be carried out. As seen in FIG. 1, a wellhead 10 is connected to a cased borehole 12 and to a tool string 14. The tool string is made in accordance with the present invention, and extends from the surface 15 of the ground, downhole into the borehole. Production tubing 16 forms part of the tool string and enables the lower end of the string to extend downhole into proximity of a hydrocarbon-containing formation 18 to be completed.

A perforating gun 20, for example a casing gun such as described in the Roy R. Vann U.S. Pat. Nos. 3,706,344 and 4,140,188, is positioned to cause the shaped charges thereof to penetrate the casing and form tunnels 23 back up into the formation. In using the present invention, a packer with as large a packer bore as possible is used. A 7-inch casing will provide a packer bore size of 4 inches which will permit a 3⅜-inch perforating gun through the packer bore. The size of the packer limits the size of the gun unless other means are used to suspend the gun below the packer prior to setting the packer. The gun includes a firing head 21 having a detonating device 22 which is accessible through the tubing interior for actuation thereof.

A one-way circulation valve 24, made in accordance with the present invention, interconnects the gun firing head with a lower tubing string 26. The tubing strings 16 and 26 are in communication with one another. The details of the valve 24 are more fully disclosed in FIG. 3, and will be more fully discussed later on in this disclosure.

As seen in FIGS. 1 and 2, a packer seal nipple or mandrel 28 is telescopingly received by a permanent packer body 30 positioned in anchored relationship respective to the casing wall of the borehole. The packer body and mandrel can take on several different forms, and are commercially available, as for example, a Baker production packer assembly seen on pages 396–400, of the aforementioned 1974–75 catalog of Baker Oil Tools, Inc. Packer mandrel 28 may have a length ranging from approximately 2 to 20 feet. A one-way vent assembly 32 of the present invention is connected to the lower end of the packer mandrel and positioned below the packer body, as indicated in FIG. 2.

Numeral 34 indicates the level of heavy mud in the lower annulus 36. The mud level 34' is often above the packer, depending upon the anticipated hydrostatic head and the location of the packer. The lower annulus is separated from the upper annulus 38 by the packer body.

Figure 3:
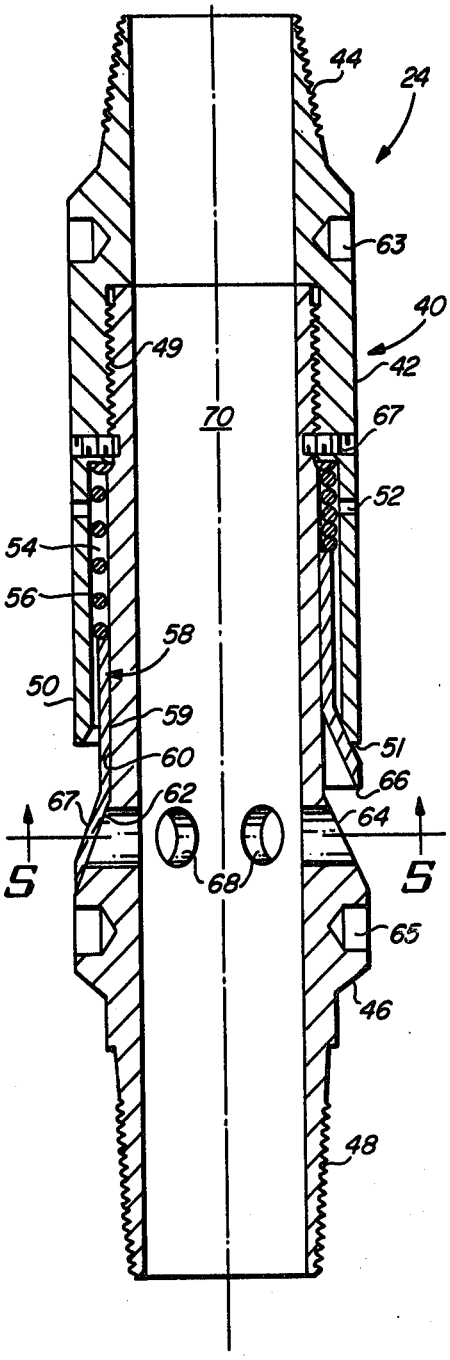
FIG. 3 is an enlarged, longitudinal, cross-sectional view of a circulating check valve which forms part of the apparatus disclosed in the foregoing figures, with the left side thereof showing the valve closed and the right side thereof showing it open.
Figure 5:
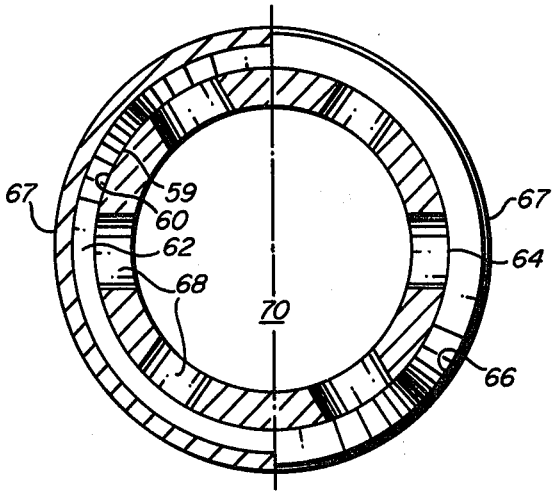
FIG. 5 is a cross-sectional view taken along line 5—5 of FIG. 3.

In FIG. 3, together with FIG. 5, there is set forth the details of the before-mentioned one-way circulation valve 24 of the present invention. The circulation valve includes a main body 40 composed of an upper sub 42 having threads 44 formed at the upper marginal terminal end thereof for attachment into a tubing string. A lower sub 46 has a threaded opposed pin end 48 for attachment within the tubing string. The upper and lower subs are threadedly mated by means of threaded interface 49. The upper sub includes a circumferentially extending skirt member which terminates at numeral 51. Weep holes 52 provide ingress and egress of liquids into a downwardly opening spring annulus 54 within which there is housed a coiled spring 56 therewithin.

An external sliding valve element 58 is made cylindrical in form and includes a relatively close tolerance fit at i.d. 59. The i.d. presents an inner peripheral wall surface which is received in low friction relationship respective to o.d. 60 of the lower sub. The valve element outwardly and downwardly diverges at 62, much like a bugle, and therefore assumes the configuration of a frustum of a cone.

The lower sub has a marginal medial portion 64 thereof which downwardly and outwardly diverges to form a conical seating surface. The seat 64 sealingly receives seal face 62 of the sleeve in sealed relationship therewith when the sleeve is moved or reciprocated in the extreme downward position seen on the left side of FIG. 3. The lowermost circumferentially extending terminal end portion 66 of the sleeve extends downwardly past the radial ports 68 when the valve is in the closed configuration and abuttingly engages the lower terminal end 51 of the skirt when moved to the fully opened position seen on the right hand side of FIG. 3.

Numerals 63 and 65 indicate small radial counterbores which facilitate the tool being threadedly made-up respective to itself and to a tool string.

Axial passageway 70 extends through the main body, with the sliding valve element, skirt, spring, valve seat, and radial ports being circumferentially disposed thereabout. Pressure effected at 70 moves valve element 58 from the closed to the opened position.

Figure 4:
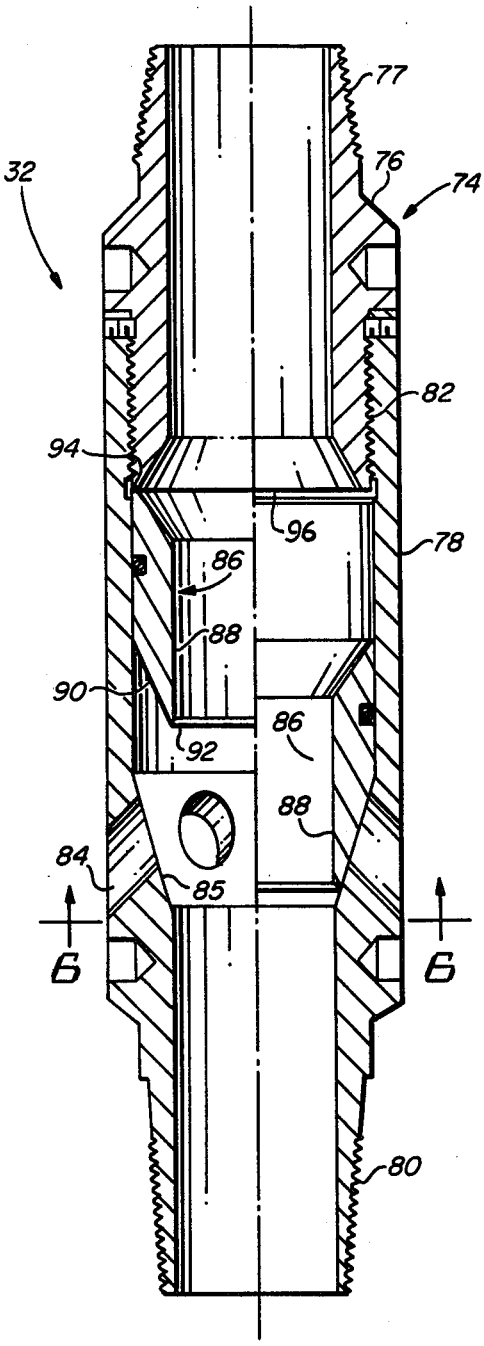
FIG. 4 is an enlarged, longitudinal, cross-sectional representation of a vent check valve, which forms part of the apparatus disclosed in FIGS. 1 and 2, with the left side thereof showing the valve open and the right side thereof showing the valve closed.
Figure 6:
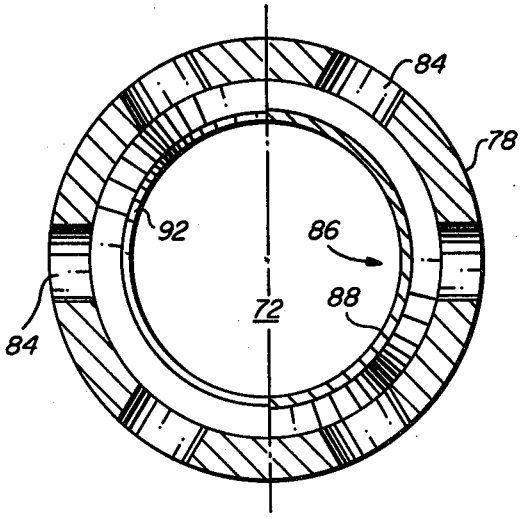
FIG. 6 is a cross-sectional representation taken along line 6—6 of FIG. 4.

In FIGS. 4 and 6, there is disclosed the details of the preferred form of the before-mentioned one-way vent assembly 32. The vent assembly includes a main body 74 made into an upper sub 76 having a threaded pin end 77 at the upper extremity thereof. The main body further includes a lower sub 78 having a threaded pin end 80 at the lower extremity thereof. The upper and lower subs are threadedly fastened to one another by the threaded interface at 82. Radial ports 84 are circumferentially positioned about a medial marginal portion of the valve body. The ports are formed through a circumferentially extending conical seal face 85. The seal face extends uphole and downhole beyond the inside surfaces which form the ports, with the valve seat, or seal face, converging in a downward direction and made complementary respective to the lower outer marginal end portion of an internal sliding valve element 86.

The sliding valve element includes an axial passageway 88 which is coaxial with the axial passageway 72 and of equal inner diameter therewith. The valve element includes a seal face 90 movable in a slidable and reciprocating manner to sealingly cover the ports 84 when the seal faces 85 and 90 sealingly engage one another as the valve is moved into the closed position by pressure effected inside of the valve structure.

Numeral 92 indicates the lower circumferentially extending terminal end portion of the slidable valve element, while numeral 94 indicates the upper circumferentially extending terminal end portion thereof. End 94 abuttingly engages shoulder 96 of the upper sub when the valve element is in the open position.

Tubing 26 between valves 24 and 32 has a length greater than the length of packer mandrel 28. Such a length permits lower check valve 24 to circulate and wash out drilling mud a distance below permanent packer 30, which is greater than the length of packer mandrel 28. Thus, once packer mandrel 28 begins to seal with permanent packer 30, upper check valve 32 which permits the inflow of drilling mud, will not travel a distance below packer 30 which would cause it to be immersed in drilling mud and permit such drilling mud to enter tubing 26. If such were to occur, drilling mud would flow into upper check valve 32 and contaminate the interior of tubing 26. As should be clear, once packer mandrel 28 begins to seal with permanent packer 30, further circulation through valve 24 is impossible and therefore upper check valve 32 must not be immersed in drilling mud but only clean circulation fluid.

Therefore, since tubing 26 has a length longer than the length of packer mandrel 28, the perforating gun and lower check valve 24 are run into the drilling mud located below the level of circulation in the hole. However, since check valve 24 will not receive any of the mud, tubing 26 maintains a clean fluid therewithin. Since tubing 26 is longer than packer mandrel 28, upper check valve 32, where drilling mud could enter, never travels below the level at which lower valve 24 washed out the mud. Often, the distance between upper check valve 32 and lower check valve 24 is approximately 30 feet.

OPERATION

The method of the present invention is carried out by attaching the gun device 20, one-way circulating valve 24, lower tubing string 26, one-way vent assembly 32, packer apparatus 30, and upper tubing string 16 in series relationship, and lowering the entire tool string downhole in the illustrated manner of FIG. 1. The packer device preferably is a permanent packer having a main body member 30 which previously was positioned downhole at the appropriate location which aligns the shaped charges of the gun with the payzone when the packer mandrel seal 28 is sealingly seated within the packer body. Alternatively, the packer body and mandrel could be assembled together and run downhole on the tubing string where the packer is positioned in the appropriate location and subsequently set after the circulation step has been carried out as described in related Patent application Ser. No. 385,707 filed June 7, 1982, entitled "Gun Firing System Using Fluid Filled Pressure Balance".

With the packer device 30 in the flow permitting position of FIG. 1, fluid is pumped down the upper tubing string 16, through the mandrel seal 28, through the one-way vent assembly 32 which is forced to remain in the closed position due to the pressure differential being greater within the tubing string 16 respective to the external pressure effected thereon. Flow continues down to the one-way circulation valve 24 where the sliding valve element 58 is forced into the open position, and fluid is therefore free to flow from the tubing 26, through the ports 68, and into the lower annulus. The circulation and washing insures that the column of mud is moving enough that it cannot settle out and plug the cased borehole. This circulation is maintained until the packer mandrel 38 reaches a position, for example, just above the permanent packer 30. Thus, just prior to stinging packer mandrel 28 into the permanent packer 30, a clean fluid may be circulated down tubing string 16 and out lower check valve 24. Thus, all mud in tubing string 16 may be washed out and replaced with a clean fluid from the firing mechanism 22 to the surface. A clear flow path of clean fluid extends throughout string 16 to permit the dropping of a detonator bar and insure sufficient strike on firing mechanism 22 to detonate gun 20. The foregoing procedure not only displaces the well fluid at 34 with clean fluid, but especially washes any debris and congealed mud from the interior of the tool string so that there can be no layer of accumulated debris over the gun firing head, which is one of the major causes of malfunction of a perforating gun.

The tool may be circulated every 1,000 feet as it is run into the well since it is possible that if circulation were not begun until lower check valve 22 was near the permanent packer, lower check valve 24 would be plugged so tight with material in the well that lower check valve 24 would not open and permit circulation. Compacted mud could prevent element 58 in lower check valve 24 from moving downwardly to open the valve. There cold be a mud plug which would provide a blockage in the cased borehole which would just not permit the downward movement of the sleeve in lower check valve 24. For example, a mud plug could consist of a rag or about 2 feet of sand in a joint of pipe. Such a plug could hold a tremendous amount of pressure even to the extent of bursting the joint before the plug was moved. But, if lower check valve 24 is opened initially, there is no problem with circulation since it has already started circulating and the circulation itself will remove any blockage.

Upon completion of circulation, tubing 16 is all free and clean with the new circulating fluid down to firing mechanism 22 since the circulation fluid has now removed the heavy mud. Once sealing nipple 28 sealingly engages the permanent packer, the pumping of circulating fluid stops. Since the formation has not yet been perforated, it is not possible to force more fluid in the bottomhole below the packer after the packer seals the annulus.

The mandrel 28 is next telescoped down into the packer body. In most instances, the fluid level is above the packer device, and the incompressible fluid must therefore be displaced from the lower annulus 36 in an amount equivalent to the displacement of the tool string that extends into the fluid after the seal has been effected at 28. This displacement of fluid is accomplished by the one-way vent assembly, which is forced into the open position as the pressure differential across the tool is increased. The displaced fluid is forced into the tubing string and flows uphole. The tool string is now in the configuration of FIG. 2, with the shaped charges being properly oriented respective to the pay zone.

A bar 23 is next dropped down through a lubricator (not shown) located at the wellhead above the upper tubing string. The bar is free to travel down through the packer mandrel seal, the one-way vent assembly, the one-way circulating valve, and impacts against the illustrated pin of the gun detonator 22, thereby causing all of the shaped charges to explode and to perforate the casing, whereupon tunnels are formed back up into the payzone. Production immediately occurs from the payzone, through the tunnels, and into the lower annulus where flow cannot enter the one-way circulating valve assembly; and, consequently, the fluid continues to flow uphole to the one-way vent valve assembly. The sliding element of the one-way vent valve is forced into the open position due to the pressure differential thereacross, so that produced fluid enters the vent assembly and continues up through the interior of the mandrel seal, through the upper production tubing, and to the surface of the ground where the produced fluid can be gathered for treatment and sale.

In FIG. 3, the face 62 of the valve element 58 provides an upward force component when sufficient pressure is applied to the interior passageway 70 to cause the element to be forced to move against the compression spring so that circulation of cleaning fluid into the lower annulus can be effected, when the packer is unseated. Flow of cleaning fluid can be continued to increase the hydrostatic head to any desired value, thereby obviating a potential wild well. The valve returns to the closed position when the pressure differential thereacross is equalized. Nitrogen can be forced down through the tubing string to force additional cleaning fluid out into the lower annulus to thereby adjust the fluid level within the tool string and within the lower borehole annulus as may be desired.

The one-way vent assembly is actuated from the closed to the open position when the pressure within the annulus 36 is increased to a value whereby the pressure differential effected through ports 84 onto the piston face 90 forces the sliding valve element to move in an upward direction, thereby permitting flow to occur from the annulus into the interior of the valve assembly.

Figure 7:
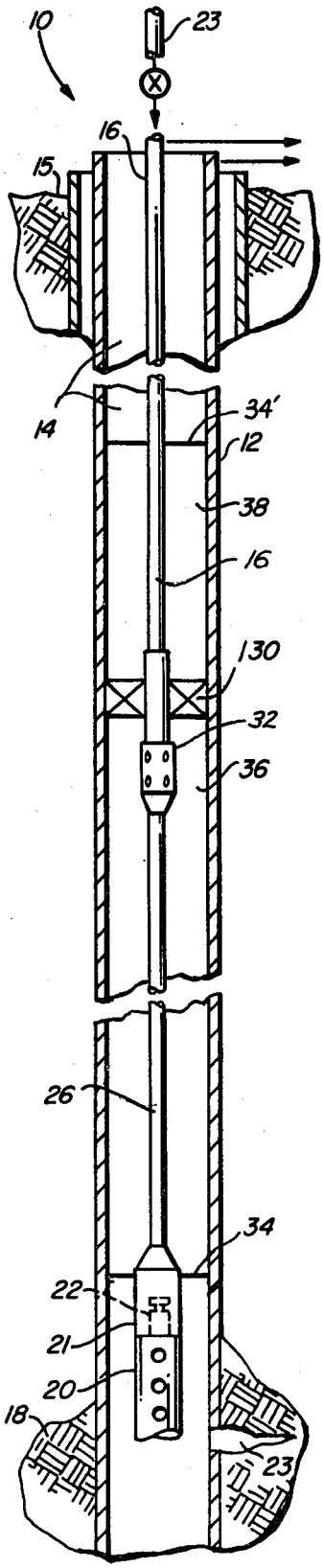
FIG. 7 is a diagrammatic representation of an alternate embodiment of the present invention.

In the embodiment of the invention disclosed in FIG. 7, a hydraulically seatable packer 130 is connected to and is run in with the tubing 16 and perforating gun 20. A one-way vent assembly 32, as more specifically seen illustrated in FIG. 4, is supported in underlying relationship respective to an ordinary hydraulically set packer device. The one-way circulating valve 24 is excluded from the tool string of FIG. 7. This combination of elements provides an upper tubing string 16 which extends downhole from the wellhead to a hydraulically actuated packer 130, with a lower tubing string 26 being connected to the one-way vent 32, and wherein the lower tubing string is connected directly to the gun firing head 21 of the gun 20. The entire tubing string is run downhole, and the packer is hydraulically set by applying pressure to the tubing string at the wellhead. Since the tool string of FIG. 7 is a closed system and flow cannot occur outwardly therefrom, the pressure effected at the upper end of the tubing 16 is also effected on the hydraulic packer device. The one-way vent assembly therefore enables the pressure differential between the tubing and ambient to develop 1200–2000 psi as may be required to properly set the packer. Thereafter, the gun can be detonated and flow occurs back up the lower annulus to force the one-way vent to the open position. This system avoids the use of a wireline for removing a profile or blanking plug, or for moving a vent assembly to the open position and at the same time permits the packer to be hydraulically set.

Depending upon the amount of underbalance or differential pressure desired, the lighter fluid in tubing 16 may be swabbed out and completely removed to obtain a maximum differential pressure or some predetermined column of lighter fluid may be obtained in tubing 16 to realize a predetermined pressure differential for backsurging. For example, seldom is it desired to have an underbalance greater than 5,000 psi. Where the formation is greater than 5,000 psi, it would be desirable to maintain a hydrostatic head of lighter fluid in tubing 16 to limit the differential pressure to approximately 5,000 psi. Thus, the underbalance of differential pressure may be controlled by the weight of the circulating fluid in tubing 16 and the height of the column of that fluid in tubing 16. The underbalance should not be greater than 5,000 psi since the tubing and casing are designed for a maximum of such pressure.

While a preferred embodiment of the invention has been shown and described, modifications thereof can be made by one skilled in the art without departing from the spirit of the invention.

I claim:

1. Method of completing a fluid producing formation located downhole in a borehole comprising the steps of:

(1) lowering a gun device downhole into a borehole on the end of a tubing string until the gun is located in close proximity of the formation to be completed;

(2) displacing the immediate fluid about the gun with a cleaning fluid by flowing the cleaning fluid down the tubing string, out of the tubing string through a one-way circulation valve positioned between the gun and the lower end of the tubing string and at a location in close proximity of the gun, and up the annulus between the borehole wall and the tubing;

(3) dividing the borehole annulus into an upper and lower annulus by closing a packer device which is located in the borehole and above the gun; whereby flow is enabled to occur from the tubing string into the lower borehole annulus and is precluded in the opposite direction;

(4) perforating the formation by detonating the gun and producing the well by flowing material from the formation, through the perforation, into the lower annulus, into the tubing string at a location below the packer device, and up the tubing string to the surface of the ground where the production fluid is gathered.

2. The method of claim 1 wherein the one-way valve is opened by fluid pressure effected within the tubing interior; and, step (3) is carried out by placing a permanent packer body downhole in the borehole, connecting a packing mandrel in the tubing string, and seating the packing mandrel within the packer body in order to close the packer device.

3. The method of claim 2 wherein flow from the lower annulus into the tubing interior is carried out by the provision of a one-way vent assembly which is connected in underlying position respective to the packer device, and which permits flow to occur from the lower annulus into the tubing string.

4. The method of claim 3 wherein the one-way vent assembly is opened in response to fluid pressure effected within the lower annulus; and, the gun device is detonated by a bar which is dropped down the tubing string and free falls to impact against a gun firing head associated with the perforating gun.

5. Method of completing a fluid producing formation located downhole in a borehole comprising the steps of:

(1) connecting a perforating gun, one-way circulating valve means, one-way vent assembly means, and a packing mandrel in series relationship within a tubing string;

(2) positioning a packer body at a location above the formation to be completed, so that when the packing mandrel is seated within the packer body, the gun is positioned adjacent the formation to be completed;

(3) lowering the tubing string of step (1) into the borehole until the packing mandrel is slightly displaced from seating within the packer body;

(4) cleaning the lower borehole annulus by flowing cleaning fluid down the tubing string, out of the circulating valve, into the lower annulus, up through the packer device, and up the upper annulus;

(5) isolating the upper and lower borehole annulus from one another by seating the packer mandrel within the packer device;

(6) completing the formation by detonating the gun, whereupon perforations are formed from the lower borehole out into the formation;

(7) producing the formation by flowing formation fluid from the formation, through the perforations, into the lower borehole annulus, into the one-way vent assembly, into the tubing string, and uphole to the surface of the earth where the production can be gathered.

6. The method of claim 5 wherein flow through the circulating valve is carried out by increasing the pressure within the tubing string and moving a pressure responsive sliding valve element in response to the rise in pressure to thereby communicate the tubing interior with the lower borehole annulus in proximity of the gun.

7. The method of claim 5 wherein flow through the one-way vent assembly is carried out by moving a valve element to the opened position in response to an increased pressure differential effected on a pressure responsive valve device thereof, wherein the increased pressure differential results from the formation being penetrated by the perforating gun discharge.

8. In a tool string for use in completing a formation located downhole in a borehole, wherein said tool string includes a perforating gun supported by a tubing, a packer device for dividing the annulus between the tubing and borehole into an upper and lower annulus, said packer includes means by which manipulation of the tubing can form a passageway from the lower to the upper annulus, the improvement comprising a vent device positioned below the packer, a circulation port means positioned above the gun;

said vent device is a normally closed, one-way vent assembly which includes a movable valve element therein which is movable by a pressure differential effected between the lower annulus and the tubing interior;

said circulation port means is a normally closed, one-way flow apparatus positioned in close proximity of the gun which includes a movable valve element therein which is movable by a pressure differential effected between the tubing interior and the lower annulus;

whereby said gun can be run into the hole and positioned near the formation to be completed, with the packer passageway being open, and clean fluid can be forced down the tubing string and through the circulation port means to displace well fluid with clean fluid, whereupon the packer passageway can then be closed, the gun detonated to perforate the formation, so the produced fluid is free to flow from the formation, through the perforations into the lower annulus to force the movable valve element of the vent device to the open position, whereupon the produced fluid can flow into the tubing and up to the wellhead.

9. The improvement of claim 8 wherein said vent device includes a sub having an axial passageway formed therethrough, and a fastener means at opposed ends thereof for connection into a tubing string; a circumferentially extending valve seat formed on the interior of the sub, an annular valve element slidably received within said sub and axially movable from a closed into an opened position; a port formed through the valve seat for communicating the axial passageway with the exterior of the sub.

10. The improvement of claim 8 wherein said circulation port means includes a sub having an axial passageway formed therethrough, fastener means at opposed ends of the sub for connection within the tool string;

an outwardly directed, downwardly sloped annular valve seat formed about a marginal circumferentially extending medial length of the exterior of said sub, a port formed through said seat for communicating the interior of the sub with the lower annulus when the port is opened to flow;

said movable valve element includes an annular sleeve slidably received about the exterior of the sub and biased into a closed position, said sleeve includes an outwardly directed port made complementary respective to said seat so that when a pressure differential is effected exteriorally of said sub, the valve element is forced to move and uncover said port.

11. The improvement of claim 10 wherein said sleeve is reciprocatingly received within a downwardly opening annular cavity;

said vent device includes a sub having an axial passageway formed therethrough, and a fastener means at opposed ends thereof for connection into a tubing string; a circumferentially extending valve seat formed on the interior of the sub, an annular valve element slidable received within said sub and axially movable from a closed into an open position, and a port formed through the valve seat for communicating the axial passageway with the exterior of the sub.

12. Well completion apparatus comprising:

detonator means;

tubular means connected around said detonator means, and extending therefrom;

first check valve means included in the tubular means adjacent said detonator means to allow flow from inside said tubular means to the exterior thereof;

second check valve means included in said tubular means farther from said detonator means than said first check valve means and allowing flow from outside to inside said tubular means.

13. Apparatus according to claim 12, including a perforating gun connected to said detonator.

14. Apparatus according to claim 13, including a seal nipple for sealing with a packer mandrel included in said tubular means farther from said detonator means than said second check valve.

15. Apparatus according to claim 14, wherein the distance between said first and second check valve means is greater than the length of said seal nipple.

16. Well completion apparatus suspended on a pipe string comprising:

vent means disposed on the pipe string for opening the pipe string to the flow of production fluids:

detonator means;

tubular means connected around said detonator means and extending to said vent means;

one way circulation valve means included in said tubular means adjacent said detonator means for allowing fluid flow from inside said tubular means adjacent said detonator means to the exterior of said tubular means, while preventing fluid flow in the opposite direction.

17. The apparatus according to claim 16, including a packer means disposed on the pipe string for sealing the pipe string with the well.

18. Method of completing a well comprising:

assembling a tool string comprising a perforating means with detonator means, a lower check valve adjacent the detonator means and an upper check valve above the lower check valve;

lowering the tool string into the well;

circulating fluid adjacent the detonator means, through the lower check valve, and into the well;

perforating the well; and producing the well by flowing production fluids through the upper check valve and into the pipe string.

19. Method of completing a fluid-containing formation through which a borehole extends comprising the steps of:

(1) lowering a gun device downhole into a borehole on the end of a tubing string including a one-way check valve permitting flow therethrough only from without the tubing string to within, until the gun is located in close proximity of the formation to be completed;

(2) dividing the borehole annulus into an upper and lower annulus by applying hydraulic pressure to the tubing interior, using the pressure differential between the tubing interior and ambient for setting a packer device which is located in the borehole and above the gun; and (3) perforating the formation by detonating the gun and producing the well by flowing material from the formation, through the perforation, into the lower annulus, and therefrom into the tubing string through the one-way check valve at a location below the packer device, and up the tubing string to the surface of the ground.

* * * * *